US007341824B2

(12) United States Patent
Sexton

(10) Patent No.: US 7,341,824 B2
(45) Date of Patent: Mar. 11, 2008

(54) MANDREL WITH CONTROLLED RELEASE LAYER FOR MULTI-LAYER ELECTROFORMED INK-JET ORIFICE PLATES

(75) Inventor: Richard W. Sexton, Huber Heights, OH (US)

(73) Assignee: Eastman Kodak Company, Rochester, NY (US)

( * ) Notice: Subject to any disclaimer, the term of this patent is extended or adjusted under 35 U.S.C. 154(b) by 94 days.

(21) Appl. No.: 11/344,425

(22) Filed: Jan. 31, 2006

(65) Prior Publication Data

US 2006/0127814 A1 Jun. 15, 2006

Related U.S. Application Data

(62) Division of application No. 10/062,141, filed on Jan. 31, 2002, now abandoned.

(51) Int. Cl.
*G03C 5/00* (2006.01)
*B41J 2/16* (2006.01)

(52) U.S. Cl. ..... 430/311; 430/320; 428/41.8

(58) Field of Classification Search ..... 430/320, 430/311; 205/67, 163, 169, 162, 283, 291; 204/281, 283; 428/41.8, 389; 427/404
See application file for complete search history.

(56) References Cited

U.S. PATENT DOCUMENTS 4,268,610 A * 5/1981 Roos ..... 430/281.1
4,773,971 A * 9/1988 Lam et al. ..... 205/75
4,972,204 A 11/1990 Sexton
5,277,783 A 1/1994 Ohashi et al.
5,462,648 A 10/1995 Nebashi et al.
5,545,511 A * 8/1996 Hulderman et al. ..... 430/315
6,303,042 B1 10/2001 Hawkins et al.

FOREIGN PATENT DOCUMENTS

EP 0 489 246 6/1992
EP 0 713 929 5/1996

* cited by examiner

*Primary Examiner*—Thorl Chea

(57) ABSTRACT

A system and method are provided for fabricating an orifice plate for use in an ink jet printing system. Initially, a substrate base is provided, and a controlled-release layer is applied to a surface of the substrate base. A conductive metal layer is adherently coated on the controlled-release layer. At least one dielectric peg is created on a portion of the conductive metal layer, and a nozzle layer is applied on the conductive metal layer to partially cover the dielectric peg. A trench is formed that covers a nozzles prior to formation of a reinforcing layer. The controlled-release layer is removed to separate the orifice plate from the substrate base. The conductive metal layer is selectively etched from the nozzle layer to complete fabricating the orifice plate.

10 Claims, 4 Drawing Sheets

MANDREL WITH CONTROLLED RELEASE LAYER FOR MULTI-LAYER ELECTROFORMED INK-JET ORIFICE PLATES

CROSS REFERENCE TO RELATED APPLICATIONS

This is a divisional application of U.S. Ser. No. 10/062,141 filed Jan. 31, 2002 now abandoned.

FIELD OF THE INVENTION

The present invention relates to ink jet printing systems, and more particularly to a mandrel with a controlled-release layer for use in fabricating multi-layer electroformed orifice plates used in such ink jet printing systems.

BACKGROUND OF THE INVENTION

In general, continuous ink jet printing apparatus have a printhead manifold to which ink is supplied under pressure so as to issue in streams from a printhead orifice plate that is in liquid communication with the cavity. Periodic perturbations are imposed on the liquid streams, such as vibrations by an electromechanical transducer, to cause the streams to break-up into uniformly sized and shaped droplets.

Orifice plates with arrays containing thousands of nozzles are required for page-wide continuous ink jet printheads. All of the nozzles must be perfectly formed, all being of uniform size and free of deformities such as flat edges. The nozzles, which are typically about 25 micron diameter, require sub-micron smoothness. This requires that great care must be exercised to provide metallic substrates free of micron-sized defects.

Highly polished metallic substrates can be made by diamond polishing. However, this is an expensive process that imparts high cost to the substrate that can be used only once. Additionally, even diamond polishing cannot ensure that every blemish is removed. Hence, small pits can result in defective holes and rejection of entire orifice arrays.

Still other prior art for making orifice plates include permanent mandrels for plating of orifice plates. This method includes plating of thin single layer orifice plates onto metalized glass substrates. This provides the desired smooth surfaces. As the orifice plate can be peeled off from the metalized glass subtrates, this method eliminates the need for corrosive etching away of the substrate, with the inherent environmental and safety hazards associated therewith. It has been found, however, that the high stresses developed during plating of the thick, multi-layer orifice plates causes the electroformed orifice plates to delaminate from the metallized substrates, making this method unsuitable for plating of thick, multi-layer orifice plates.

It is seen then that there is a need for an improved substrate that is more readily separable from electroformed orifice plate structures, to overcome the problems associated with the prior art.

SUMMARY OF THE INVENTION

This need is met by the improved substrate according to the present invention, wherein a controlled adhesion makes the substrate readily separable from electroformed orifice plate structures. The present invention provides the desired smooth substrate, while minimizing the need for corrosive etching in allowing thick orifice plates to be fabricated. An organic layer is interposed between a substantial and recyclable base substrate and the electroformed orifice plate. The organic layer provides improved smoothness and a non-damaging means for parting the orifice plate from the base substrate.

A system and method are provided for fabricating an orifice plate for use in an ink jet printina system. Initially, a substrate base is provided, and a controlled-release layer is applied to a surface of the substrate base. A conductive metal layer is adherently coated on the controlled-release layer. At least one dielectric peg is created on a portion of the conductive metal layer, and a nozzle layer is applied on the conductive metal layer to partially cover the dielectric peg. A trench is formed that covers a nozzle prior to formation of a reinforcing layer. The controlled-release layer is removed to senarate the orifice nlate from the substrate base. The conductive metal layer is selectively etched from the nozzle layer to complete fabricating the orifice plate.

Objects and advantages of the invention will be apparent from the following description, the accompanying drawings and the appended claims.

DETAILED DESCRIPTION OF THE INVENTION

The present invention proposes an improved substrate having controlled adhesion, making it particularly suitable for electroforming thick and/or multi-layer orifice plates.

Figure 1:
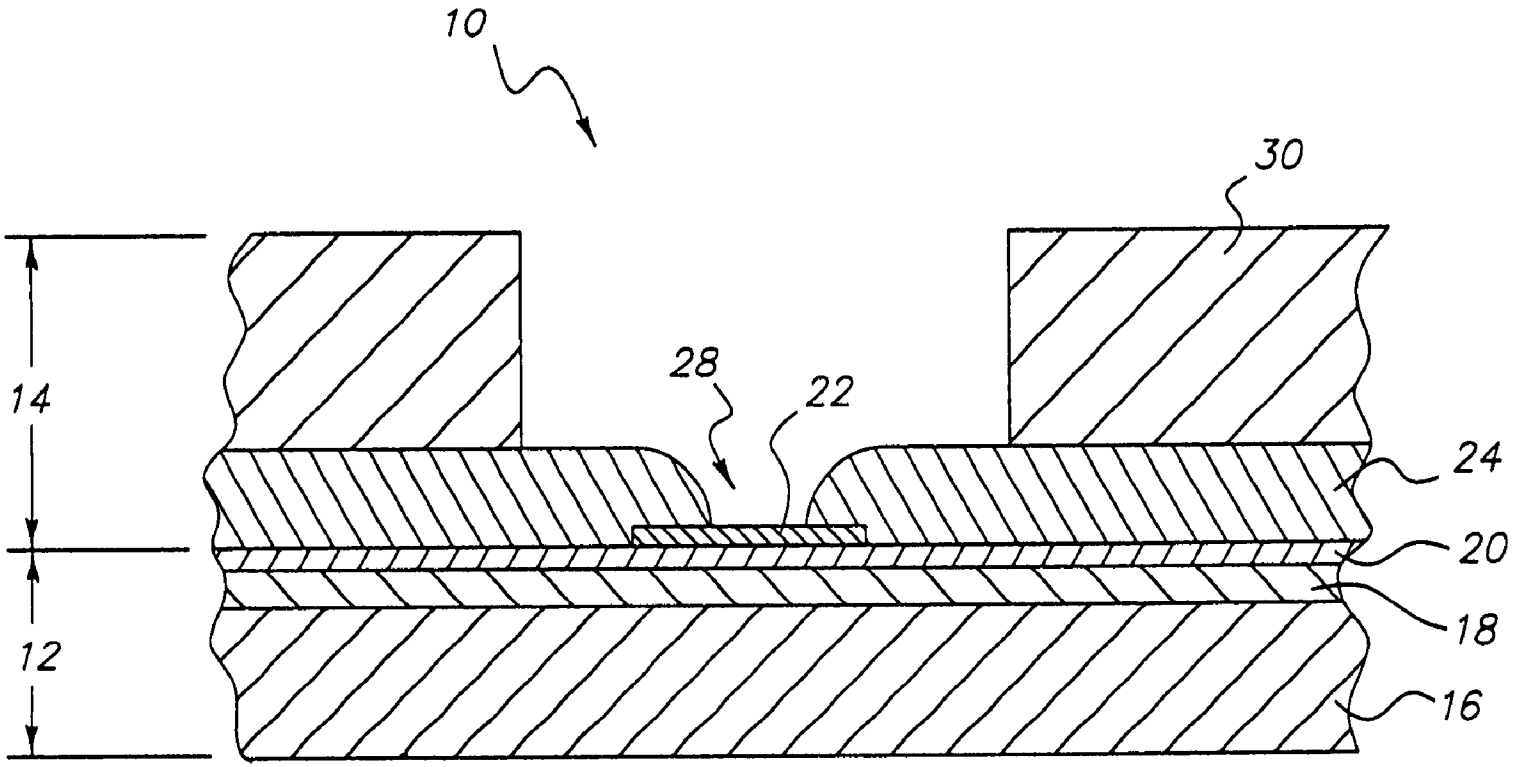
FIG. 1 is a cross sectional view of a composite mandrel with an orifice plate formed thereon, in accordance with the present invention.
Figure 2A:
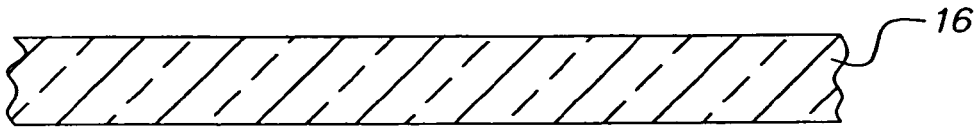
FIGS. 2A-2G illustrate the build up of layers of FIG. 1, for fabricating orifice plates in accordance with the present invention.

Referring to the drawings, FIG. 1 illustrates a cross sectional view of the arrangement of various layers of the structure 10, having a composite mandrel 12 with an orifice plate 14 formed therein, according to the present invention. Initially, as shown in FIG. 2A, a substrate base 16 is provided, preferably having a polished surface. The polished surface can be achieved by any suitable means, such as mechanical polishing. As this surface will be covered by a controlled-release layer, it is not necessary to polish the surface to the degree required by the prior art. Therefore, the highly expensive diamond polishing used in the prior art can be eliminated.

Figure 2B:
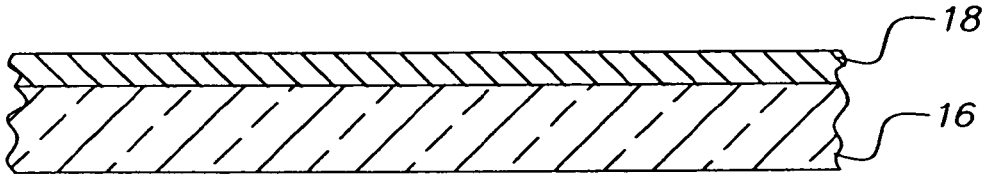

The substrate used may be a metal such as brass that is not attacked by the chemicals used in electroforming processes, or glass with a chrome coating. As illustrated in FIG. 2B, a smooth controlled-release layer 18 is applied to the polished surface of the substrate 16. The smooth controlled-release layer 18 may be achieved by spin coating to apply an organic chemical layer, such as a positive photoresist, approximately 0.5 micron thick onto the substrate base. In one embodiment, the controlled-release layer 18 is chosen to be sacrificial in that it is inherently brittle and readily dissolved in a solvent such as acetone. Commercially available resists, such as Shipley 1818, dry with a glass-like, striation-free surface.

Figure 2C:
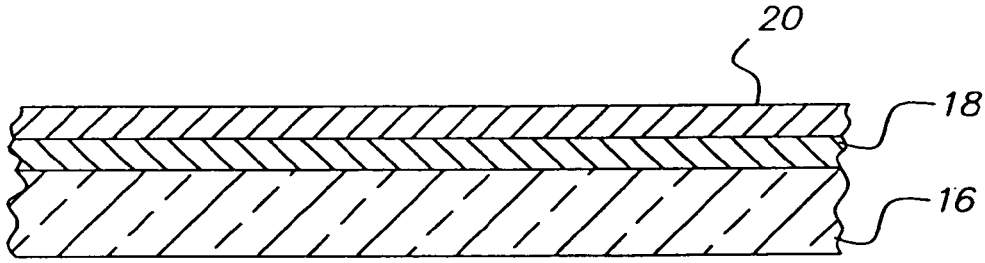
Figure 2D:
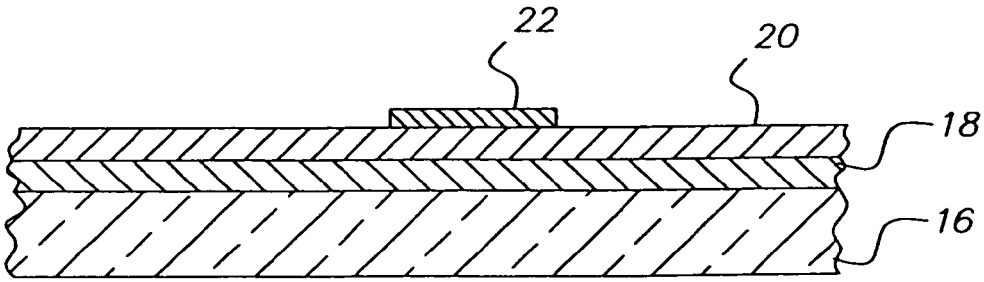
Figure 2E:
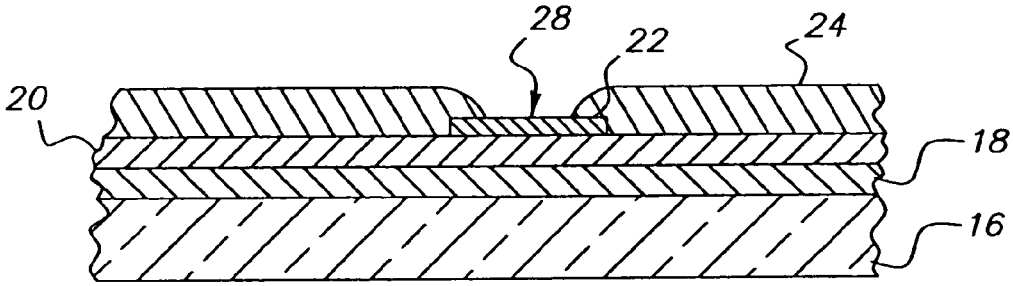
Figure 2F:
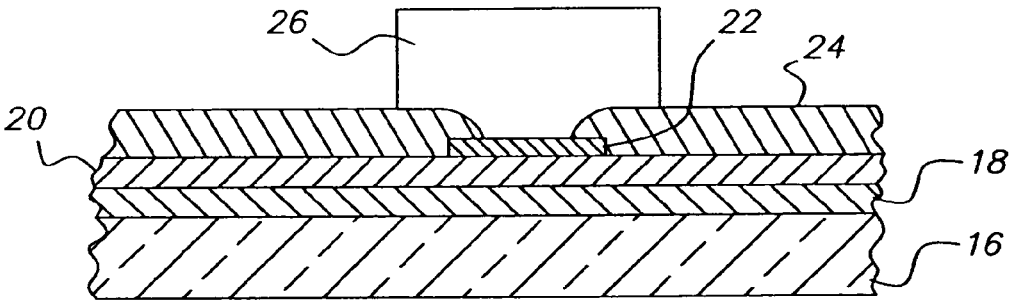
Figure 2G:
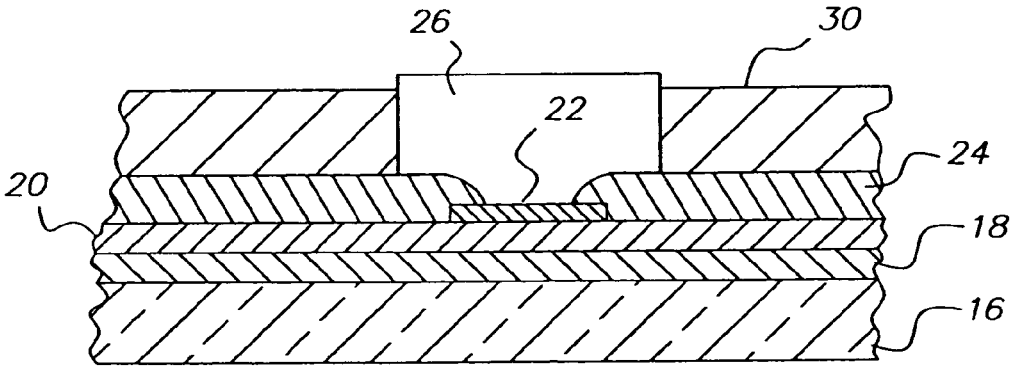

In order to make the resist surface ready for electroplating, a conductive metal layer 20, preferably copper about 0.1 micron thick, is adherently coated, by means such as sputtering, on the surface of the photoresist layer, as shown in FIG. 2C. This thin copper layer 20 replicates the smooth surface of the resist and is ideal for deposition of thin resist dielectric pegs 22, such as is shown in FIG. 2D, which pegs define the nozzles for the orifice plate. Continuing to FIG. 2E, nickel layers 24 are adherently built up on the thin copper 20 by electroplating. Hence, the nickel layers 24 do not delaminate in process as they would if, for example, a passive metallic substrate were used in place of the adherently coated resist of the present invention.

Two layer nickel structures are used in ink jet generators, wherein the added stiffness of the orifice plate enhances uniform transfer of vibration to the ink jets. The nickel nozzle layer 24 is composed of fine grained nickel so that the edge of the orifice(s) or nozzle(s) 28 is very smooth. A trench mask 26 is formed over the orifice(s) or nozzle(s) 28 for protection during a second deposition of nickel. The second disposition of nickel is a second or reinforcing nickel trench layer 30 used to increase the overall thickness. Subsequent removal of the trench mask 26 leaves an open trench where ink can freely flow to the orifice (s) or nozzle(s) 28. Between plating of the first nozzle layer 24 and the second or reinforcing nickel trench layer 30, considerable thermal and chemical stress is applied in order to activate a good bond between the two nickel layers. If the nozzle layer 24 is not held firmly to the substrate, it will peel during the activation and ruin the orifice(s) or nozzle(s) 28.

Figure 3A:
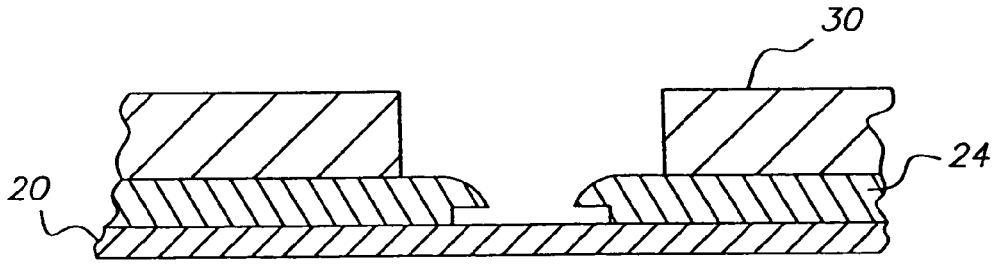
FIGS. 3A and 3B illustrate the resultant formed nozzle, when applying the technique of the present invention.
Figure 3B:
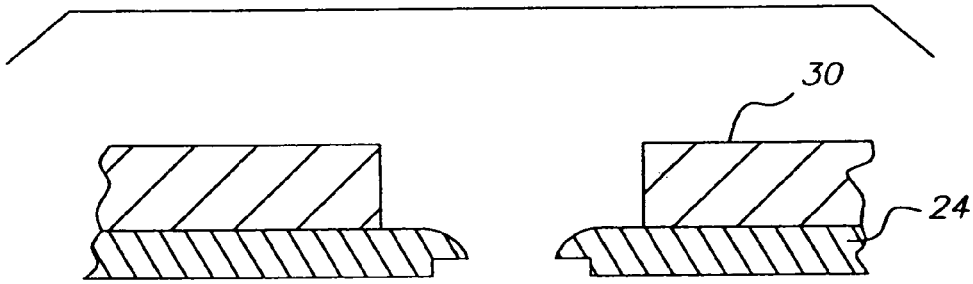

When both layers are plated, the photoresist layer 18 is removed to separate the orifice plate from the mandrel base. For removal and recycling, the orifice plate 14 of FIG. 1 can be soaked in acetone until the parting or sacrificial resist layer 18 is dissolved, resulting in the structure shown in FIG. 3A. Alternatively, the multilayer orifice plate 14 may be carefully peeled, fracturing the brittle parting or sacrificial resist layer 18. Resist can then be chemically stripped from the orifice plate 14 and the base substrate 16. The thin copper layer 20 which has remained on the separated orifice plate is then removed with a selective etchant, leaving the completed orifice plate structure shown in FIG. 3B. The selective etchant would remove copper but not damage the nickel during the short immersion period required to etch away the copper. The orifice plate is then ready to be assembled into an ink jet printhead.

After the orifice plate is removed from the substrate, the substrate can be cleaned, and is then ready for reprocessing by applying a new photoresist release layer and a new sputtered copper layer. This process for making mandrels with the controlled-release layer produces the desired smooth surface for thick orifice plates fabrication without the expensive polishing operations, making it cost effective even if the mandrel 12 is only used once.

The invention has been described in detail with particular reference to certain preferred embodiments thereof, but it will be understood that variations and modifications can be effected within the spirit and scope of the invention.

The invention claimed is:

1. A method of fabricating an orifice plate for use in an ink jet printing system, comprising the steps of:

providing a substrate base;

applying a controlled-release layer to a surface of the substrate base;

adherently coating a conductive metal layer on the controlled-release layer;

creating at least one dielectric peg on a portion of the conductive metal layer;

applying a nozzle layer on the conductive metal layer wherein the nozzle layer partially covers the at least one dielectric peg;

forming a trench that covers a nozzle prior to formation of a reinforcing layer;

removing the controlled-release layer to separate the orifice plate from the substrate base;

selectively etching the conductive metal layer from the nozzle layer to complete fabricating the orifice plate.

2. A method as claimed in claim 1 wherein the substrate base comprises a metal substrate not attacked by chemicals used in electroforming processes.

3. A method as claimed in claim 1 wherein the substrate base comprises a chrome coated glass substrate.

4. A method as claimed in claim 1 wherein the controlled-release layer comprises an organic chemical layer.

5. A method as claimed in claim 4 wherein the organic chemical layer comprises a photoresist.

6. A method as claimed in claim 1 wherein the conductive metal layer comprises a copper layer.

7. A method as claimed in claim 1 wherein the conductive metal layer comprises a conductive layer having an approximate thickness of 0.1 micron.

8. A method as claimed in claim 1 wherein the step of adherently coating comprises the step of sputtering.

9. A method as claimed in claim 1 wherein the controlled-release layer comprises a controlled-release layer having an approximate thickness of 0.5 micron.

10. A method as claimed in claim 1 wherein the controlled-release layer comprises a controlled-release layer applied to the substrate base by spin coating.

* * * * *